US005412954A

United States Patent [19]

Grenier

[11] Patent Number: 5,412,954

[45] Date of Patent: May 9, 1995

[54] APPARATUS FOR CRYOGENIC TREATMENT, SUCH AS AIR DISTILLATION

[75] Inventor: Maurice Grenier, Paris, France

[73] Assignee: L'Air Liquide, Societe Anonyme pour L'Etude et L'Exploitation des Precedes Georges Claude, Paris Cedex, France

[21] Appl. No.: 119,359

[22] Filed: Sep. 10, 1993

[30] Foreign Application Priority Data

Sep. 16, 1992 [FR] France ..... 92 11051

[51] Int. Cl.[6] ..... F25J 3/00

[52] U.S. Cl. ..... 62/36; 62/22

[58] Field of Search ..... 62/22, 30, 36, 42, 45.1

[56] References Cited

U.S. PATENT DOCUMENTS

| | | | |
|---|---|---|---|
| 1,240,397 | 9/1917 | Wolf | 62/42 |
| 1,354,380 | 9/1920 | Crommett | 62/42 |
| 2,480,093 | 8/1949 | Anderson | 62/30 |
| 2,999,366 | 9/1961 | La Fave et al. | 62/45.1 |
| 3,130,561 | 4/1964 | Hnilicka, Jr. | 62/42 |
| 3,167,417 | 1/1965 | Sellmaier et al. | 62/36 |
| 3,930,375 | 1/1976 | Hofmann | 62/45.1 |

FOREIGN PATENT DOCUMENTS 1295048 6/1961 France .

OTHER PUBLICATIONS

"Air Liquefying Separating Device," *Patent Abstracts of Japan,* vol. 13, No. 434, Nippon Sanso K.K., Sep. 28, 1989.

*Primary Examiner*—Ronald C. Capossela
*Attorney, Agent, or Firm*—William S. Frommer

[57] ABSTRACT

In this apparatus, the treatment column is insulated by means of a sheath under vacuum while the heat exchange line is insulated by means of a cold box under atmospheric pressure containing a solid insulating material such as a material in particulate form.

12 Claims, 3 Drawing Sheets

APPARATUS FOR CRYOGENIC TREATMENT, SUCH AS AIR DISTILLATION

BACKGROUND OF INVENTION (a) Field of the Invention

The present invention relates to an apparatus for cryogenic treatment, such as air distillation, of the type comprising a cryogenic treatment column and a heat exchange line to cool at least one fluid to be treated before its introduction into the column.

(b) Description of Prior Art

The operation of air distillation apparatuses requires heat insulating the cold parts at very low temperature which are essentially heat exchange line, the distillation column and the various "cold" accessories such as the valves and possibly liquid oxygen or liquid nitrogen pumps and/or expansion turbines.

Actually, insulation under vacuum of the apparatus as a whole is by far the most thermically performing technique. Unfortunately, its cost is high and its possibilities of use are limited, such as for the following reasons.

(1) For reasons of accessibility, the cold accessories as a whole mentioned above should be placed outside a sheath under vacuum, which requires a number of inlets/outlets ducts on this sheath.

(2) A sheath under vacuum, which by definition is cylindrical, is poorly adaptable for placing a distillation column therein, which is often quite high, and also one or more parallelipedic heat exchangers of the type with brazed plates. The result is a limitation on the sizes of the apparatuses which can be disposed in the sheath yet still permit easy transportability.

For these reasons, insulation under vacuum has been limited to apparatuses of small sizes, i.e. capable of treating a flow of air of the order of a few thousands of $m^3/h$, such as those which are kept cold by injection into the column of a cryogenic liquid of exterior origin, and which is relatively costly (so-called liquid assist apparatuses).

The invention aims at providing a heat insulation technique for apparatuses of cryogenic treatment in which the performances are close to an insulation under vacuum of the apparatus as a whole in spite of a substantially reduced cost, and which can be used with apparatuses of relatively large size while enabling easy transportation.

SUMMARY OF INVENTION

For this purpose, it is an object of the invention to provide an apparatus for the cryogenic treatment of air of the type mentioned above, characterized in that the column is insulated by means of a main sheath under vacuum, while the heat exchange line is insulated by means of a main cold box under atmospheric pressure containing a solid insulating material, such as in particulate form.

According to other characteristics:

- the cold accessories of the apparatus as a whole, such as valves and possibly pumps and/or expansion turbines, are insulated under atmospheric pressure by means of a solid insulating material, such as in particulate form;
- the said cold accessories as a whole are combined into an auxiliary cold box coupled to the main cold box;

- the auxiliary cold box is also provided with the hot accessories of the apparatus, so as to constitute a service module;
- the apparatus comprises a heat insulated connection cold box which contains the ducts as a whole which connect the main cold box to the main sheath under vacuum;
- the connection cold box is under atmospheric pressure and contains an insulating solid material, such as in particulate form;
- the apparatus, intended for air distillation, comprises a double column for air distillation in the main sheath under vacuum, and a column for the production of impure argon, which is insulated under vacuum;
- the column for the production of impure argon is inside an auxiliary sheath under vacuum which is connected to the main sheath under vacuum;
- the column for the production of impure argon is located in the main sheath under vacuum;
- the column for air distillation, such as one consisting of a double distillation column, has an outside diameter which is constant along its entire height.

BRIEF DESCRIPTION OF DRAWINGS

An embodiment of the invention will now be described with reference to the annexed drawing, in which.

DESCRIPTION OF PREFERRED EMBODIMENTS

Figure 1:
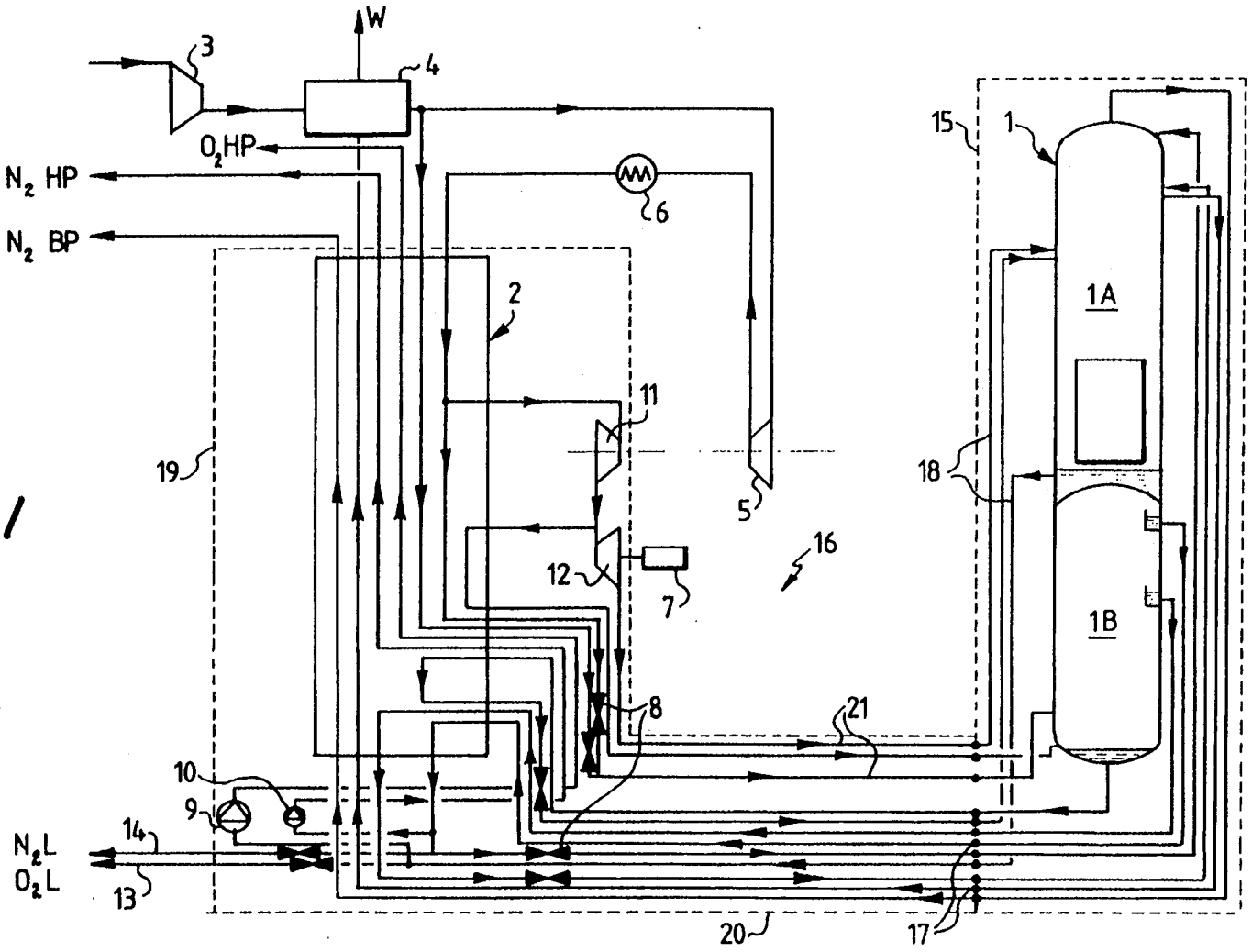
FIG. 1 is a schematic illustration of an apparatus for air distillation according to the invention.

The apparatus illustrated in the drawing is intended to produce mainly oxygen gas under elevated pressure, nitrogen gas under elevated pressure and nitrogen gas under low pressure. It consists essentially of a double distillation column 1, a heat exchange line 2 and various accessories.

These accessories fall into two categories:

- on the one hand, "hot" accessories operating under room temperature or above, namely an air compressor 3, a device 4 for removing water and $CO_2$ from air by adsorption, which is regenerated with the residual gas W of the double column (impure nitrogen), a blower 5 for boosting part of the purified air, a water cooler 6 for this blower, and an alternator-brake 7;
- on the other hand, "cold" accessories, i.e. operating well below room temperature: numerous valves 8, in which some are stop or control valves and others are expansion valves; a liquid oxygen pump 9; a liquid nitrogen pump 10; and two turbines 11, 12 mounted in series in which the first one is coupled to the blower 5 while the second one is decelerated by the alternator brake 7.

It should be noted however, that as in the case of the turbines, the pumps are connected to a hot element, namely their operating electrical motor. The turbines and the pumps may therefore be mounted in the vicinity of the cold box 19, eventually in specific casings which are insulated with perlite and are coupled to this cold box.

The operation of the apparatus will not be described in detail, since it is known per se except for its means of heat insulation. Only certain characteristics of the apparatus will be indicated hereinbelow.

The double column 1 is of the type "with minaret", i.e. the low pressure production nitrogen originates from the top of the low pressure column 1A. High pressure oxygen and high pressure nitrogen are both obtained by pumping, respectively liquid oxygen withdrawn at the bottom of column 1A and mean pressure liquid nitrogen withdrawn at the top of the mean pressure column 1B, and vaporization in the exchange line 2 of the liquids thus compressed.

To achieve this vaporization, air circulates in the exchange line 2 under three different pressures: part of the air is under the compression pressure of compressor 3; a second part of the air, boosted at 5, is under an elevated pressure which is higher than this compression pressure; and a third part of the air, withdrawn between the two turbines 11 and 12, is under the mean pressure of column 1B. Moreover, the air which exits from turbine 12 is blown under low pressure into column 1A.

The apparatus also produces liquid oxygen via duct 13 and liquid nitrogen via duct 14.

The heat insulation of the apparatus will now be described.

Figure 2:
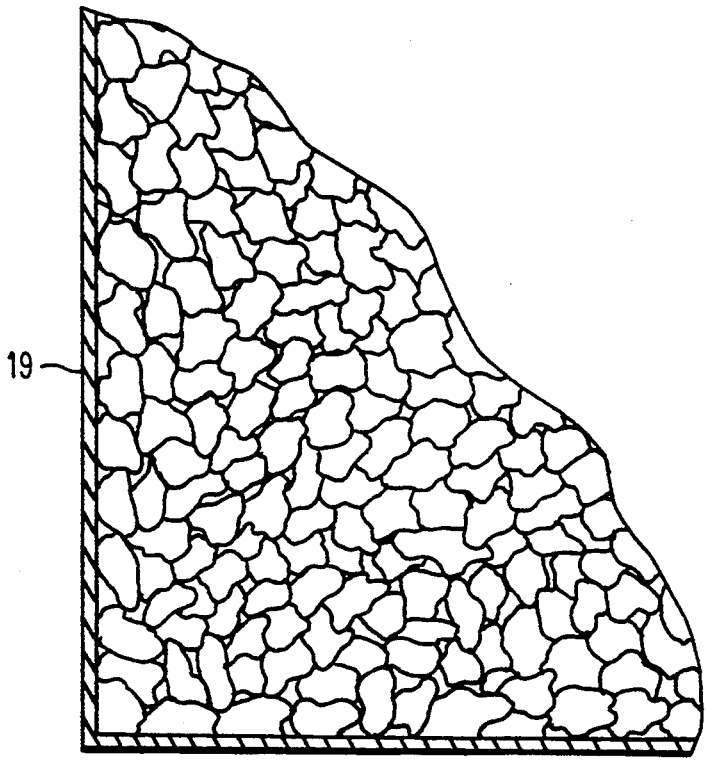
FIG. 2 is a schematic illustration of the cold box with an insulating material, such as perlite.

This insulation consists of two parts of different nature: on the one hand, a cylindrical sheath 15 under vacuum which surrounds the double column 1, and on the other hand means 16, for insulation under atmospheric pressure, using an insulating material in particulate form which is preferably perlite as shown, for example, in FIG. 2.

Sheath 15 includes a certain number of inlets/outlets 17 for the ducts as a whole which feed the double column and originating from the latter (twelve in number in the illustrated example) and contains only the double column and the sections of duct 18 connecting the latter to the corresponding inlets/outlets.

The insulation means 16 consist of two cold boxes filled with perlite under atmospheric pressure: a main cold box 19 containing the exchange line 2 and the whole of the cold accessories, namely valves 8, pumps 9 and 10 and turbines 11 and 12, and a cold connection box 20 which contains all the duct sections 21 connecting the cold box 19 to the inlets/outlets of the sheath under vacuum 15.

With this mode of insulation, the sheath under vacuum may have a diameter which is closely adapted to the exterior diameter of the double column, which may have a constant diameter along its entire height, which enables to provide a double column 1-sheath 15 assembly conveniently transportable for substantial column diameters, corresponding to productions of oxygen which may reach up to about 1000 tons/day.

Moreover, all the cold accessories 8 to 12 are easily accessible since they are constantly under atmospheric pressure.

On an energetic point of view, this solution is also quite advantageous, although it is much less costly than an insulation under vacuum containing the whole of the apparatus. As a matter of fact, in an apparatus for air distillation, 75 to 85% of the heat losses are incurred by the double column and, in the heat exchange line, the losses are concentrated in the colder part. In total, the insulation performances of the assembly 15–16 are of the order of 90% of those obtained with an insulation under vacuum of the apparatus as a whole.

Figure 3:
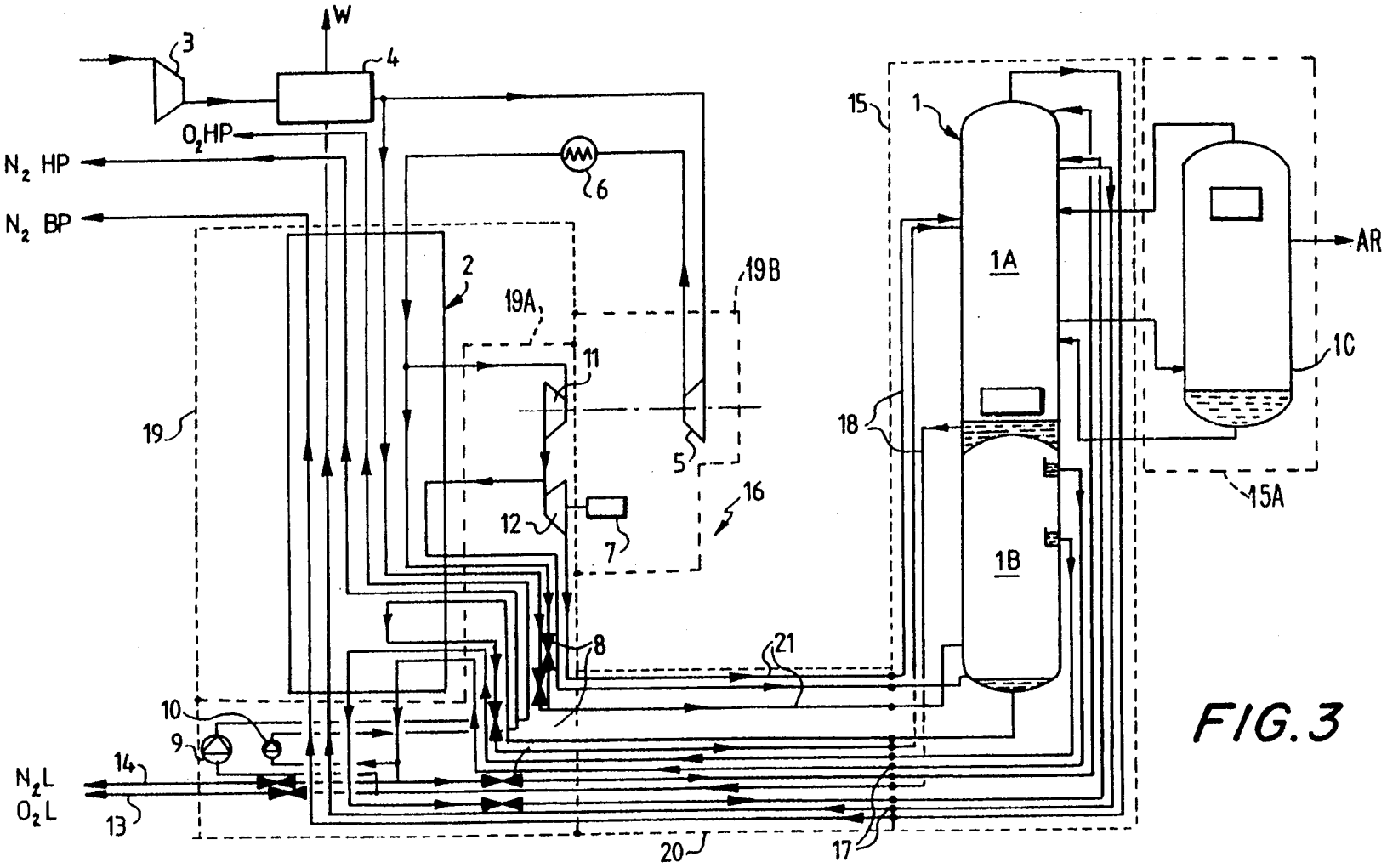
FIG. 3 is a schematic illustration of variants of the apparatus shown in FIG. 1.

As a variant, the cold accessories 8 to 11 as a whole may be mounted in an auxiliary cold box which is filled with perlite, under atmospheric pressure, which is coupled to the main cold box 19A shown in FIG. 3, 19 for connecting accessories. In this auxiliary box 19A, there may be provided spaces without perlite to receive hot accessories, including the control box of the apparatus, or it is also possible to mount the latter opposite the auxiliary box 19A, so as to constitute a service module 19B which contains all the accessories.

Also as a variant, and as depicted in FIG. 3, the double column may be completed by a column for the production of impure argon which is connected to the low pressure column 1A, in which case this additional column 1C may be located in sheath 15, or be disposed in a sheath 15A under auxiliary vacuum coupled to sheath 15 and connected to the latter by means of a cold connection box similar to cold box 20 and designed for the passage there through of the ducts which are required for the operation of the column for the production of impure argon.

It will be understood that the invention is also applicable to other types of apparatuses including a cryogenic treatment column and a heat exchange line serving to cool the fluid(s) treated in this column, for example apparatuses for washing a gas with liquid nitrogen.

I claim

1. Apparatus for cryogenic treatment comprising a cryogenic treatment column, a heat exchange line to cool at least one fluid to be treated, means for supplying said at least one fluid through said heat exchange line a main sheath under vacuum disposed about said column for insulating said column, and a main cold box under atmospheric pressure containing a solid insulating material for insulating said heat exchange line, said heat exchange line being disposed within said main cold box.

2. Apparatus according to claim 1, further including cold accessories insulated under atmospheric pressure by means of a solid insulation material.

3. Apparatus according to claim 2, wherein said cold accessories are consolidated into an auxiliary cold box coupled to the main cold box.

4. Apparatus according to claim 3, further including hot accessories, said hot accessories being disposed in said auxiliary cold box to constitute a service module.

5. Apparatus according to claim 1, further including a heat insulated cold connection box which contains all ducts connecting apparatus within the main cold box to apparatus within the main sheath.

6. Apparatus according to claim 5, wherein the cold connection box is under atmospheric pressure and contains a solid insulating material.

7. Apparatus according to claim 1, wherein said treatment column comprises a double air distillation column in the main sheath and a column for the production of impure argon which is insulated under vacuum.

8. Apparatus according to claim 7, further comprising an auxiliary sheath under vacuum connected to the main sheath under vacuum, and wherein said column for the production of impure argon is contained in said auxiliary sheath.

9. Apparatus according to claim 7, wherein the column for the production of impure argon is located in said main sheath.

10. Apparatus according to claim 1, wherein the treatment column has an exterior diameter which is constant along its entire height.

11. Apparatus according to claim 1 wherein said treatment column is an air distillation column.

12. Apparatus according to claim 1 wherein said solid insulation material is in particulate form.

* * * * *